US012312704B2

(12) United States Patent
Manz et al.

(10) Patent No.: US 12,312,704 B2
(45) Date of Patent: May 27, 2025

(54) PLATINUM ELECTROLYTE

(71) Applicant: Umicore Galvanotechnik GmbH, Schwaebisch Gmuend (DE)

(72) Inventors: Uwe Manz, Moegglingen (DE); Bernd Weyhmueller, Alfdorf Hintersteinenberg (DE)

(73) Assignee: Umicore Galvanotechnik GmbH, Schwaebisch Gmuend (DE)

( * ) Notice: Subject to any disclaimer, the term of this patent is extended or adjusted under 35 U.S.C. 154(b) by 0 days.

(21) Appl. No.: 18/550,784

(22) PCT Filed: Mar. 28, 2022

(86) PCT No.: PCT/EP2022/058075
§ 371 (c)(1),
(2) Date: Sep. 15, 2023

(87) PCT Pub. No.: WO2022/207539
PCT Pub. Date: Oct. 6, 2022

(65) Prior Publication Data

US 2024/0150920 A1 May 9, 2024

(30) Foreign Application Priority Data

Mar. 29, 2021 (DE) ..... 10 2021 107 826.1

(51) Int. Cl.
*C25D 3/50* (2006.01)
*C25D 3/56* (2006.01)
*C25D 7/00* (2006.01)

(52) U.S. Cl.
CPC ..... *C25D 3/50* (2013.01); *C25D 3/567* (2013.01); *C25D 7/00* (2013.01)

(58) Field of Classification Search
None
See application file for complete search history.

(56) References Cited

U.S. PATENT DOCUMENTS

| | | | |
|---|---|---|---|
| 3,480,523 | A | 11/1969 | Tyrrell |
| 7,300,562 | B2 | 11/2007 | Hu |
| 2004/0055895 | A1 | 3/2004 | Hu |
| 2010/0176001 | A1 | 7/2010 | Tsai |
| 2021/0324497 | A1 | 10/2021 | Weyhmueller |

FOREIGN PATENT DOCUMENTS

| | | | |
|---|---|---|---|
| DE | 1256504 | 12/1967 | |
| EP | 0737760 | 10/1996 | |
| WO | 2013104877 | 7/2013 | |
| WO | 2020083799 | 4/2020 | |
| WO | 2020250174 | 12/2020 | |
| WO | WO-2020250174 A1 * | 12/2020 | ..... C25D 3/567 |

OTHER PUBLICATIONS

Pushpavanam (Journal of Applied Electrochemistry '2006' 36:1069-1074). (Year: 2006).*
Cobley et al., The use of Insoluble Anodes in Acid Sulphate Copper Electrodeposition Solutions, May 1, 2001, pp. 112-118, vol. 79, No. 3, Publisher: Transactions of the IMF.
Kanani, N, , pp. 84-86, Publisher: Galvanotechnik; Hanser Verlag, Mnchen Wien, 2000; Seite 84 ff.
"https://de.wikipedia.org/wiki/Lab-Farbraum", Lab Color Space—EN ISO 11664-4, Aug. 9, 2021, Publisher: Wikipedia.
Sheela, et al., A bromide electrolyte for the electrodeposition of platinum and platinumiridium alloy, Jan. 26, 2005, pp. 77-81, vol. 83, Publisher: Trans Inst Met Finish.
International Search Report received in PCT/EP2022/058075 mailed Jul. 8, 2022.
Written Opinion received in PCT/EP2022/058075 mailed Jul. 8, 2022.

* cited by examiner

*Primary Examiner* — Wojciech Haske
(74) *Attorney, Agent, or Firm* — Suzannah K. Sundby, Esq.; Canady + Lortz LLP

(57) ABSTRACT

The present invention is directed toward a platinum electrolyte which contains certain additives, and to a method for the electrolytic deposition of a platinum layer with the aid of the electrolyte according to the invention.

12 Claims, No Drawings

PLATINUM ELECTROLYTE

The present invention is directed toward a platinum electrolyte which contains certain additives, and also to a method for the electrolytic deposition of a platinum layer with the aid of the electrolyte according to the invention.

Electroplating and electroforming with platinum are widely used in the production of ornaments and jewelry, not only on account of the bright luster and aesthetic appeal of platinum, but also on account of its high chemical and mechanical inertness. Platinum can therefore also serve as a coating for plug connections and contact materials.

Galvanic baths are solutions containing metal salts from which electrochemically metallic precipitates (coatings) can be deposited on substrates (objects). Galvanic baths of this kind are often also referred to as 'electrolytes'. Accordingly, aqueous galvanic baths are hereinafter referred to as 'electrolytes'.

Acidic and alkaline baths or electrolytes based on platinum(II) and platinum(IV) compounds are used for the electrodeposition of platinum. The most important bath types contain diamino dinitrito platinum(II) (P-salt), sulfato dinitrito platinic acid (DNS), or hexahydroxoplatinic acid, or their alkali salts.

In WO2013104877A1, a platinum electrolyte is proposed that should be stable over a longer duration and contains a source of platinum ions and a source of borate ions. The bath generally has good thermal stability. The bath can also be used over a wide range of pH values. In certain embodiments, the baths yield a bright and shiny deposit.

EP737760A1 describes a Pt electrolyte which contains at most 5 g/l of free amidosulfuric acid (ASS, sulfamidic acid, sulfamic acid, amidosulfonic acid) and 20 to 400 g/l of a strong acid with a pH value of less than 1. The platinum amine sulfamate complexes used here proved to be surprisingly stable in the strongly acidic bath without free amidosulfuric acid. The bath showed no precipitate formation even given long electrolysis durations.

Amidosulfonic acid released during the deposition of the platinum is hydrolyzed, and therefore should not accumulate in the electrolyte. However, in less strongly acidic baths and at normal electrolysis temperatures, hydrolysis is comparatively slow.

In DE1256504B, an acidic platinum electrolyte is proposed with which firmly adhering layers of platinum can be produced. In the electrolyte, more than 20 mg/l of bismuth should be present in order to be able to ensure a certain overvoltage characteristic of the anodes produced in this way. The electrolyte contains hydrochloric acid. In-house experiments have yielded that higher bismuth concentrations in the electrolyte negatively influence the deposition result. With 100 mg/l, for example, dark platinum deposits are obtained.

US20100176001A1 mentions a platinum electrolyte which, among other things, should also include citric acid in addition to bismuth. The aim is to obtain nanometer particles of platinum or a platinum alloy which can serve as a catalyst. Not mentioned is why it is advantageous to add the transition metals to the electrolyte in a concentration of 0.1 micromol/l to 100 mol/l.

It is especially important for the production of contact materials to achieve high throughput rates in the electrolytic coating in order to be able to ensure the lowest possible production costs per piece. These throughput rates are achieved in that, among other things, the current density during coating is chosen to be very high in order to provide a rapid deposition of the platinum. During the deposition of platinum from an acidic electrolyte, especially with platinum ammine sulfamate complexes (analogous to EP737760A1), however, the use of high current densities produces black platinum particles in the form of clouds which accumulate in the electrolyte, incorporate into the platinum layer, or attach to the deposited platinum surface. This results in uneven deposits provided with growths. These have disadvantageous properties in terms of gloss, corrosion resistance. and abrasion resistance. To obtain flawless layers from these platinum electrolytes, it is therefore necessary to deposit at low current densities.

An achievement of the posed object is arrived at completely surprisingly but none the less advantageously in that an aqueous, cyanide-free electrolyte is provided for the deposition of platinum or platinum alloys on electrically conductive substrates, which electrolyte comprises one or more ions from the group consisting of Ir, Bi, Sb, Se, and Te and which also does not contain hydrochloric acid, wherein Bi, Sb, Se, and Te are present in a concentration of up to 100 mg/l of electrolyte and Ir is present in a concentration of up to 1000 mg/l of electrolyte (respectively in relation to the metal). Even under high current densities, platinum or platinum alloy deposition can take place very quickly, without black clouds of platinum particles forming in the electrolyte which interfere with deposition. This leads to improved productivity and thus lower production costs, as well as to flawless layers.

Platinum electrolytes known to the person skilled in the art can be used as electrolytes for the present purpose. Advantageously, such a Pt electrolyte is used which has platinum sulfamate complexes. The latter may be selected from the group consisting of $H_2[Pt(NH_2SO_3)_2SO_4]$, $H_2[Pt(NH_2SO_3)_2SO_3]$, $H_2[Pt(NH_2SO_3)_2Cl_2]$, $[Pt(NH_3)_2(NH_2SO_3)_4]$, and $[Pt(NH_3)_2(NH_2SO_3)_2]$. $H_2[Pt(NH_2SO_3)_4]$ and $[Pt(NH_3)_2(NH_2SO_3)_2]$ can also be especially advantageously used. The molar ratios of the ligands to platinum may thereby vary. Such electrolytes are known from the prior art to the person skilled in the art. One is cited in EP737760A1, for example. Such electrolytes are also commercially available (PLATUNA® H 1 from the company Umicore Galvanotechnik GmbH; PLATUNA® S 1; *PLATUNA® N 1 Platinum Electrolyte I Electroplating* (*umicore.com*)).

In the deposition of platinum from the electrolyte according to the invention, the one or more ions from the group consisting of Bi, Sb, Se, Ir, and Te can be co-deposited to a certain extent. The obtained deposition then has from 1 ppm to 5000 ppm, preferably from 100 to 2000 ppm, of the correspondingly used metals. This likewise applies to the deposition of platinum alloy. As further alloy metals, all those suitable for the present purpose in the view of the person skilled in the art come into consideration. Alloy metals would preferably be PGM noble metals Rh, Pd, Ru, Re, and furthermore non-noble metals such as Ni, Co, In, Cu, Fe etc., wherein Rh is especially preferred in this context. Even in the event of PtRh alloy electrolytes with the Pt complexes, the black clouds arise in electrolytic deposition at high amperage, which can be avoided by the use according to the invention of one or more ions from the group consisting of Ir, Bi, Sb, Se, and Te.

Coming under consideration as suitable electrically conductive substrates are those which can be coated in the acidic pH range with the electrolyte according to the invention. These are preferably noble metal-containing substrates or corresponding coatings on less noble substrates. This relates, for example, to ferrous materials which have been nickel-plated or copper-plated and subsequently optionally goldplated, pre-palladiumed, pre-platinumed, or coated with pre-silver. The intermediate layers for nickel plating or copper plating can thereby also be made from corresponding alloy electrolytes—e.g. NiP, NiW, NiMo, NiCo, NiB, Cu, CuSn, CuSnZn, CuZn etc. A further substrate material can be a wax core which has been pre-coated with conductive silver lacquer (electroforming).

Coming under consideration as suitable additives which aid in preventing the formation of free platinum in the electrolyte during deposition are water-soluble compounds that have Bi, Sb, Se, Ir, and Te atoms in ionic form. These can be used individually or optionally in combination in the electrolyte. The amount of additives Bi, Sb, Se, and Te should be dimensioned such that a concentration of 100 mg/l of electrolyte is not exceeded. Concentrations below 50 mg/l are advantageous, and the concentration of these additives in the electrolyte is especially preferably 5-20 mg/l. The concentration is thereby in relation to the metal. An exception is hereby iridium, which is added in concentrations of up to 1000 mg/l, i.e., for example, 100 to 1000 mg/l, preferably 200 to 700 mg/l, and very especially preferably 300-600 mg/l.

Bismuth can likewise be added to the electrolyte by means of compounds known to the person skilled in the art. The bismuth is preferably present in the (III) oxidation state. Advantageous compounds in this context are those selected from bismuth(III) oxide, bismuth(III) hydroxide, bismuth (III) fluoride, bismuth(III) chloride, bismuth(III) bromide, bismuth(III) iodide, bismuth(III) methanesulfonate, bismuth (III) nitrate, bismuth(III) tartrate, bismuth(III) citrate, especially ammonium bismuth citrate.

The selenium or tellurium compound which is used in the electrolyte can be appropriately selected by the person skilled in the art within the framework of the concentrations indicated above. Suitable selenium and tellurium compounds are those in which selenium or tellurium is present in +4 or +6 oxidation states. Selenium and tellurium compounds are advantageously used in the electrolyte in which selenium or tellurium in the +4 oxidation state is present. The selenium and tellurium compounds are preferably selected especially from tellurites, selenites, tellurous acid, selenious acid, telluric acid, selenic acid, selenocyanates, tellurocyanates, and selenate as well as tellurate. The use of tellurium compounds rather than selenium compounds is thereby generally preferred. The addition of tellurium to the electrolyte in the form of a salt of the tellurous acid, for example in the form of potassium tellurite, is especially preferred.

Coming under consideration as suitable iridium compounds which can be added to the electrolyte are compounds in different oxidation states. The following iridium compounds, such as, for example, iridium(III) chloride, iridium (IV) chloride, hexachloroiridium(III) acid, hexachloroiridium(IV) acid, [Na,K,ammonium] hexachloroiridate(III), [Na, K,ammonium]hexachloroiridate(IV), iridium(III) bromide, iridium(IV) bromide, hexabromoiridium(III) acid, hexabromoiridium(IV) acid, [Na,K,ammonium]hexabromoiridate (III), [Na,K,ammonium] hexabromoiridate(IV), iridium(III) sulfate, iridium(IV) sulfate. In addition, the corresponding iodides. The iridium chloro compounds, more preferably the iridium sulfates, are preferably used.

The antimony compounds that can be added to the electrolyte are known to the person skilled in the art. These can be selected from the group of antimony(III) compounds consisting of antimony(III) fluoride, antimony(III) chloride, antimony(III) oxide, sodium antimony(III) oxide tartrate, antimony(III) compounds with sugar alcohols (e.g. glycerol, sorbitol, mannitol etc.). Antimony(III) oxide and sodium antimony(III) oxide tartrate are preferably used. Antimony (III) oxide is very especially preferably used for the present purpose.

In the present electrolyte, depending on the application, it is furthermore typically possible to use anionic and non-ionic surfactants as wetting agents, such as, for example, polyethylene glycol adducts, fatty alcohol sulfates, alkyl sulfates, alkyl sulfonates, aryl sulfonates, alkyl aryl sulfonates, heteroaryl sulfates, betains, fluorosurfactants, and salts and derivatives thereof (see also: Kanani, N: Galvanotechnik; Hanser Verlag, Munich Vienna, 2000; pp. 84 ff). Wetting agents are also, for example, substituted glycine derivatives which are known commercially as Hamposyl®. Hamposyl® consists of N-acyl sarcosinates, i.e. condensation products of fatty acid acyl residues and N-methylglycine (sarcosine). Silver coatings that are deposited with these baths are white and glossy to highly glossy. The wetting agents lead to a non-porous layer. Further advantageous wetting agents are those selected from the following group:

- anionic wetting agents such as, for example, n-dodecanoyl-n-methylglycine, (N-lauroylsarcosine) Na salt, alkyl collagen hydrolysate, 2-ethylhexyl sulfate Na salt, lauryl ether sulfate Na salt, 1-naphthalene sulfonic acid Na salt, 1,5-naphthalene disulfonic acid Na salt, sodium monoalkyl sulfates such as, for example, sodium tetradecyl sulfate, sodium dodecyl sulfate, sodium ethylhexyl sulfate, sodium decyl sulfate, sodium octyl sulfate and mixtures thereof, are especially advantageous;
- non-ionic wetting agents such as, for example, beta-naphthol ethoxylate potassium salt, fatty alcohol polyglycol ethers, polyethylene imines, polyethylene glycols and mixtures thereof. Wetting agents with a molecular weight below 2,000 g/mol;
- cationic wetting agents such as, for example, 1H-imidazolium-1-ethenyl (or 3-methyl)-, methylsulfate homopolymers.

The electrolyte according to the invention is used in an acidic pH range, but can also be operated in a different pH range, for example up to pH 9. Optimal results can be obtained with pH values of 4-0.1 in the electrolyte. The person skilled in the art will know how to adjust the pH value of the electrolyte. This is preferably in the strongly acidic range, more preferably <2. It is extremely advantageous to select strongly acidic deposition conditions given which the pH value is less than 2 and possibly may even reach below 1, or even 0.5 in borderline cases.

In principle, the pH value can be adjusted as required by the person skilled in the art. The person skilled in the art will, however, be guided by the idea of introducing as few additional substances into the electrolyte as possible that could adversely affect the deposition of the alloy in question. In an especially preferable embodiment, the pH value will therefore be adjusted solely by adding an acid. As such, all compounds can be used which, in the view of the person skilled in the art, are suitable for a corresponding application. They will preferably employ strong acids for this purpose, especially methanesulfonic acid or mineral acids such as sulfuric acid, or orthophosphoric acid.

In addition to the abovementioned substances, the platinum electrolyte according to the invention contains as few other substances as possible, since the risk of deterioration of the deposition increases with each additional additive. In addition to the above ingredients, it is possible that only conductive salts such as Na sulfate, K sulfate, or corresponding phosphates are added to the electrolyte. In a preferred embodiment, the electrolyte according to the invention especially does not comprise any citric acid.

The present electrolyte delivers a shiny deposit giving a silvery impression. The deposited platinum layer advantageously has an L* value of over +82. The a* value is preferably −1 to 1 and the b* value is between +2 and +9, according to the Cielab color system (EN ISO 11664-4—latest version as of the filing date). The values were determined with a Konica Minolta CM-700d.

The subject matter of the present invention is likewise a method for depositing a platinum or platinum alloy layer on an electrically conductive substrate, in which method the electrolyte according to the invention is used, an anode and, as cathode, the substrate to be coated are brought into contact with the electrolyte, and a current flow is established between anode and cathode.

The temperature prevailing during deposition of the platinum can be selected as desired by the person skilled in the art. They will thereby be guided on the one hand by an adequate deposition rate and the applicable current density range, and on the other hand by economic aspects or the stability of the electrolyte. It is advantageous to set a temperature of the electrolyte of 20° C. to 90° C., preferably 40° C. to 70° C., and especially preferably 45° C. to 65° C.

As has already been indicated, the electrolyte according to the invention is an acidic type. It may be that fluctuations with respect to the pH value of the electrolyte occur during electrolysis. In one preferred embodiment of the present method, the person skilled in the art will therefore proceed so that they monitor the pH value during electrolysis and adjust it to the setpoint value if necessary. The person skilled in the art knows how to proceed here.

Layer thicknesses in the range of 0.1 to 10 μm are typically deposited in rack operation for technical and decorative applications, with current densities in the range from 1 to 5 A/dm$^2$. For technical applications, a layer thickness of up to 25 μm is sometimes also deposited. In the continuous systems preferentially used for the electrolyte according to the invention, layer thicknesses over a relatively large range of approx. 0.5 to approx. 5 μm are deposited at the highest possible deposition rates, and thus the highest possible current densities of, for example, between 0.5 and 10 A/dm$^2$. In addition, there are also special applications in which relatively high layer thicknesses of a few 10s of μm up to a few millimeters are deposited, for example in the event of electroforming.

Instead of direct current, pulsed direct current can also be applied. The current flow is thereby interrupted for a certain period of time (pulse plating). The application of simple pulse conditions, for example such as 1 s current flow ($t_{on}$) and 0.5 s pulse pause ($t_{off}$) at average current densities, yielded homogeneous, glossy, and white coatings.

The current density that is established in the electrolyte between the cathode and the anode during the deposition process can be selected by the person skilled in the art on the basis of the efficiency and quality of deposition. Depending on the application and type of coating system, the current density in the electrolyte is advantageously set to 0.2 to 50 A/dm$^2$. If necessary, current densities can be increased or reduced by adjusting the system parameters, such as the design of the coating cell, flow rates, anode or cathode relationships etc. A current density of 0.5-50 A/dm$^2$ is advantageous, 1-25 A/dm$^2$ is preferable, and 5-20 A/dm$^2$ is especially preferable.

In the context of the present invention, low, medium, and high current density ranges are defined as follows:

Low current density range: 0.1 to 0.75 A/dm$^2$,

Medium current density range: greater than 0.75 A/dm$^2$ to 2 A/dm$^2$,

High current density range: greater than 2 A/dm$^2$.

The electrolyte according to the invention and the method according to the invention can be used for the electrolytic deposition of platinum coatings for technical applications, for example electrical plug connectors and printed circuit boards, and for decorative applications such as jewelry and watches. For technical applications, continuous systems are preferably used.

Various anodes can be employed when using the electrolyte. Only insoluble anodes are thereby usable. Preferred as insoluble anodes are those made of a material selected from the group consisting of platinized titanium, graphite, mixed metal oxides, glass carbon anodes, and special carbon material ("diamond-like carbon", DLC), or combinations of these anodes.

Insoluble anodes of platinized titanium or titanium coated with mixed metal oxides are advantageous, wherein the mixed metal oxides are preferably selected from iridium oxide, ruthenium oxide, tantalum oxide, and mixtures thereof. Iridium-transition metal mixed oxide anodes composed of iridium-ruthenium mixed oxide, iridium-ruthenium-titanium mixed oxide, or iridium-tantalum mixed oxide are also advantageously used for execution of the invention. More information may be found in Cobley, A. J et al. (The use of insoluble anodes in acid sulfate copper electrodeposition solutions, Trans IMF, 2001,79(3), pp. 113 and 114).

The term "electrolyte bath" is understood according to the invention to mean the aqueous electrolyte which is put into a corresponding vessel and used with an anode and a cathode under current flow for electrolysis.

The electrolyte according to the invention is aqueous. The compounds are preferably salts or complexes that are soluble in the electrolyte. The terms 'soluble salt' and 'soluble complex' therefore refer to those salts and complexes that dissolve in the electrolyte at the working temperature. The working temperature is thereby that temperature at which electrolytic deposition takes place. In the context of the present invention, a substance is deemed soluble if at least 1 mg/l of this substance dissolves in the electrolyte at the working temperature.

EXAMPLES

The electrolyte preparations for the depositions were implemented as follows. First, 400 ml of deionized water was put into a 1 l beaker. Then, under intensive stirring, the corresponding quantity of acid, the quantity of platinum, the wetting agent, and finally the corresponding additive were added. This solution was then topped up with deionized water to the final volume of 1 l. Brass sheets measuring 0.2 dm$^2$, which had been pre-coated with nickel and gold, were coated under movement of electrolyte and product. The depositions took place over a current density range of 1-20 A/dm$^2$. Particle formation in the electrolyte was assessed. The results were recorded in the following table.

| No. | Acid | Acid [ml/l] | Platinum | Platinum [g/l] | Wetting agent | Metal | Metal [mg/l] | Anodes | Temperature | 1 A/dm$^2$ | 2 A/dm$^2$ | 5 A/dm$^2$ | 10 A/dm$^2$ | 15 A/dm$^2$ | 20 A/dm$^2$ |
|---|---|---|---|---|---|---|---|---|---|---|---|---|---|---|---|
| 1 | H2SO4 | 100 | H2[Pt(NH2SO3)2SO4] | 10 | 5 | — | — | MMO | 55 | 1 | 2 | 2 | 2 | 2 | 2 |
| 2 | H2SO4 | 50 | [Pt(NH3)2(NH2SO3)4] | 12 | 5 | Antimony(III) fluoride | 20 | MMO | 50 | 0 | 0 | 0 | 1 | 2 | 2 |
| 3 | H2SO4 | 50 | H2[Pt(NH2SO3)4] | 12 | 2 | Antimony(III) chloride | 10 | Pt/Ti | 50 | 0 | 0 | 0 | 0 | 1 | 1 |
| 4 | CH4O3S | 100 | H2[Pt(NH2SO3)2SO4] | 5 | 10 | Antimony(III) oxide | 5 | MMO | 70 | 0 | 0 | 0 | 0 | 0 | 1 |
| 5 | H3PO4 | 100 | H2[Pt(NH2SO3)2SO4] | 8 | 4 | Sodium antimony(III) oxide tartrate | 15 | Pt/Ti | 70 | 0 | 0 | 0 | 1 | 1 | 2 |
| 6 | H2SO4 | 10 | H2[Pt(NH2SO3)2Cl2] | 15 | 15 | Bismuth(III) oxide | 10 | Pt/Ti | 40 | 0 | 0 | 0 | 0 | 1 | 1 |
| 7 | H3PO4 | 10 | H2[Pt(NH2SO3)2SO3] | 7 | 12 | Bismuth(III) hydroxide | 15 | Pt/Ti | 40 | 0 | 0 | 0 | 0 | 0 | 1 |
| 8 | H2SO4 | 20 | [Pt(NH3)2(NH2SO3)2] | 9 | 6 | Bismuth (III) fluoride | 20 | MMO | 55 | 0 | 0 | 0 | 0 | 1 | 1 |
| 9 | H2SO4 | 20 | H2[Pt(NH2SO3)2SO3] | 6 | 8 | Bismuth(III) chloride | 15 | MMO | 55 | 0 | 0 | 0 | 0 | 0 | 1 |
| 10 | H3PO4 | 25 | H2[Pt(NH2SO3)4] | 12 | 12 | Bismuth(III) bromide | 5 | MMO | 60 | 0 | 0 | 0 | 0 | 1 | 1 |
| 11 | CH4O3S | 25 | [Pt(NH3)2(NH2SO3)2] | 8 | 10 | Bismuth(III) iodide | 5 | Pt/Ti | 70 | 0 | 0 | 0 | 0 | 0 | 1 |
| 12 | CH4O3S | 10 | H2[Pt(NH2SO3)4] | 10 | 12 | Bismuth (III) methanesulfonate | 10 | MMO | 55 | 0 | 0 | 0 | 0 | 0 | 1 |
| 13 | CH4O3S | 15 | [Pt(NH3)2(NH2SO3)2] | 14 | 5 | Bismuth(III) nitrate | 15 | Pt/Ti | 55 | 0 | 0 | 0 | 0 | 1 | 1 |
| 14 | H3PO4 | 20 | H2[Pt(NH2SO3)2SO3] | 5 | 6 | Bismuth (III) tartrate | 10 | Pt/Ti | 40 | 0 | 0 | 0 | 0 | 0 | 1 |
| 15 | H2SO4 | 70 | H2[Pt(NH2SO3)2Cl2] | 8 | 10 | Bismuth(III) citrate | 5 | Pt/Ti | 40 | 0 | 0 | 0 | 0 | 0 | 1 |
| 16 | H3PO4 | 70 | H2[Pt(NH2SO3)2SO4] | 12 | 5 | Ammonium bismuth citrate | 5 | MMO | 45 | 0 | 0 | 0 | 0 | 0 | 1 |
| 17 | H3PO4 | 50 | [Pt(NH3)2(NH2SO3)2] | 12 | 2 | Selenic acid | 30 | MMO | 60 | 0 | 0 | 0 | 1 | 1 | 2 |
| 18 | H3PO4 | 100 | H2[Pt(NH2SO3)2SO3] | 12 | 6 | Selenocyanate | 10 | MMO | 60 | 0 | 0 | 0 | 0 | 1 | 1 |
| 19 | CH4O3S | 100 | [Pt(NH3)2(NH2SO3)2] | 15 | 3 | Tellurocyanate | 20 | MMO | 60 | 0 | 0 | 0 | 0 | 1 | 1 |
| 20 | CH4O3S | 55 | [Pt(NH3)2(NH2SO3)2] | 15 | 10 | Selenate | 10 | Pt/Ti | 65 | 0 | 0 | 0 | 0 | 1 | 2 |
| 21 | H2SO4 | 25 | [Pt(NH3)2(NH2SO3)2] | 10 | 8 | Iridium sulfate | 500 | MMO | 55 | 0 | 0 | 0 | 0 | 0 | 1 |
| 22 | H2SO4 | 40 | H2[Pt(NH2SO3)2SO4] | 8 | 12 | Potassium tellurite | 5 | MMO | 65 | 0 | 0 | 0 | 0 | 0 | 1 |
| 23 | H2SO4 | 35 | [Pt(NH3)2(NH2SO3)2] | 5 | 15 | Antimony(III) chloride | 5 | MMO | 70 | 0 | 0 | 0 | 0 | 1 | 1 |
| 24 | H3PO4 | 40 | [Pt(NH3)2(NH2SO3)2] | 5 | 3 | Sodium antimony(III) oxide tartrate | 5 | MMO | 70 | 0 | 0 | 0 | 0 | 1 | 1 |
| 25 | H3PO4 | 35 | H2[Pt(NH2SO3)2Cl2] | 5 | 4 | Bismuth(III) bromide | 10 | MMO | 55 | 0 | 0 | 0 | 0 | 0 | 1 |
| 26 | H2SO4 | 60 | H2[Pt(NH2SO3)2SO3] | 15 | 6 | Selenocyanate | 15 | Pt/Ti | 60 | 0 | 0 | 0 | 0 | 1 | 2 |
| 27 | H2SO4 | 80 | H2[Pt(NH2SO3)2SO4] | 14 | 12 | Selenocyanate | 10 | Pt/Ti | 55 | 0 | 0 | 0 | 0 | 1 | 2 |
| 28 | H2SO4 | 80 | [Pt(NH3)2(NH2SO3)2] | 12 | 11 | Sodium antimony(III) oxide tartrate | 15 | Pt/Ti | 40 | 0 | 0 | 0 | 0 | 1 | 1 |
| 29 | CH4O3S | 80 | H2[Pt(NH2SO3)2SO4] | 15 | 15 | Bismuth (III) tartrate | 10 | MMO | 45 | 0 | 0 | 0 | 0 | 0 | 1 |
| 30 | CH4O3S | 100 | [Pt(NH3)2(NH2SO3)2] | 8 | 12 | Potassium tellurite | 10 | Pt/Ti | 70 | 0 | 0 | 0 | 0 | 0 | 1 |
| 31 | H3PO4 | 100 | [Pt(NH3)2(NH2SO3)4] | 6 | 5 | Tellurocyanate | 5 | MMO | 60 | 0 | 0 | 0 | 0 | 0 | 1 |
| 32 | H3PO4 | 45 | [Pt(NH3)2(NH2SO3)4] | 10 | 2 | Ammonium bismuth citrate | 5 | MMO | 45 | 0 | 0 | 0 | 0 | 0 | 1 |
| 33 | H3PO4 | 90 | H2[Pt(NH2SO3)4] | 10 | 2 | Tellurocyanate | 20 | MMO | 55 | 0 | 0 | 0 | 0 | 1 | 1 |
| 34 | CH4O3S | 90 | H2[Pt(NH2SO3)4] | 7 | 7 | Antimony(III) chloride | 50 | Pt/Ti | 55 | 0 | 0 | 0 | 0 | 1 | 2 |
| 35 | H2SO4 | 40 | H2[Pt(NH2SO3)2SO4] | 10 | 5 | Iridium chloride | 200 | MMO | 60 | 0 | 0 | 0 | 0 | 0 | 1 |
| 36 | H2SO4 | 20 | H2[Pt(NH2SO3)2SO3) | 6 | 8 | Hexabromoiridate | 100 | MMO | 55 | 0 | 0 | 0 | 0 | 0 | 1 |
| 37 | CH4O3S | 30 | [Pt(NH3)2(NH2SO3)2] | 9 | 5 | Bismuth(III) tartrate | 15 | Pt/Ti | 60 | 0 | 0 | 0 | 0 | 0 | 1 |
| 38 | CH4O3S | 30 | [Pt(NH3)2(NH2SO3)4] | 12 | 15 | Bismuth(III) methanesulfonate | 10 | MMO | 70 | 0 | 0 | 0 | 0 | 0 | 1 |
| 39 | H2SO4 | 25 | [Pt(NH3)2(NH2SO3)2] | 10 | 8 | Potassium tellurite | 5 | MMO | 70 | 0 | 0 | 0 | 0 | 1 | 1 |
| 40 | H2SO4 | 10 | [Pt(NH3)2(NH2SO3)4] | 5 | 5 | Antimony(III) chloride | 5 | MMO | 70 | 0 | 0 | 0 | 0 | 1 | 2 |
| 41 | H2SO5 | 20 | [Pt(NH3)2(NH2SO3)4] | 20 | 5 | Iridium iodide | 50 | MMO | 60 | 0 | 0 | 0 | 0 | 1 | 1 |

-continued

| No. | Acid | Acid [ml/l] | Platinum | Platinum [g/l] | Wetting agent | Metal | Metal [mg/l] | Anodes | Temperature | 1 A/dm$^2$ | 2 A/dm$^2$ | 5 A/dm$^2$ | 10 A/dm$^2$ | 15 A/dm$^2$ | 20 A/dm$^2$ |
|---|---|---|---|---|---|---|---|---|---|---|---|---|---|---|---|

Particle formation: 2 = strong, 1 = weak, 0 = none (minimal)

It was shown that, compared to Experiment 1 (no additive), the particle formation with the additive in the electrolyte was significantly minimized during the depositions.

The invention claimed is:

1. An aqueous, cyanide-free electrolyte for the deposition of platinum or platinum alloys on electrically conductive substrates, wherein the electrolyte (a) has one or more ions selected from the group consisting of Ir, Bi, Sb, Se, and Te, wherein Bi, Sb, Se, and Te are present in a concentration of up to 100 mg/l of electrolyte and Ir is present in a concentration of up to 500 mg/l of electrolyte, (b) does not contain hydrochloric acid, (c) has platinum sulfamate complexes, (d) a pH of <2, and (e) lacks particles of platinum or platinum alloys when under a current density of up to 5A/dm$^2$.

2. The electrolyte according to claim 1, wherein the electrolyte does not contain citric acid.

3. A method for depositing a platinum or platinum alloy layer on an electrically conductive substrate, which comprises contacting the electrolyte according to claim 1 with an anode and the substrate to be coated as cathode, and providing a current flow between the anode and the cathode.

4. The method according to claim 3, wherein the temperature of the electrolyte during deposition is 20-90° C.

5. The method according to claim 3, wherein the deposition is performed in continuous systems.

6. The method according to claim 3, wherein the current density during deposition is between 0.5-50 A/dm$^2$.

7. The electrolyte according to claim 1, wherein the electrolyte does not contain citric acid.

8. An aqueous, cyanide-free electrolyte for the deposition of platinum or platinum alloys on electrically conductive substrates, wherein the electrolyte (a) has one or more ions selected from the group consisting of Bi, Sb, Se, and Te in a concentration of up to 100 mg/l of electrolyte, (b) does not contain hydrochloric acid, (c) has platinum sulfamate complexes, (d) a pH of <2, and (e) lacks particles of platinum or platinum alloys when under a current density of up to 5A/dm$^2$.

9. A method for depositing a platinum or platinum alloy layer on an electrically conductive substrate, which comprises contacting the electrolyte according to claim 8 with an anode and the substrate to be coated as cathode, and providing a current flow between the anode and the cathode.

10. The method according to claim 9, wherein the temperature of the electrolyte during deposition is 20-90° C.

11. The method according to claim 9, wherein the deposition is performed in continuous systems.

12. The method according to claim 9, wherein the current density during deposition is between 0.5-50 A/dm$^2$.

* * * * *